United States Patent [19]

McLean

[11] Patent Number: 4,824,108

[45] Date of Patent: Apr. 25, 1989

[54] REBOUNDING BALL GAME

[76] Inventor: David McLean, 643 Sheraton Rd., Burlington, Ontario, Canada, L7L 4B3

[21] Appl. No.: 137,569

[22] Filed: Dec. 24, 1987

[51] Int. Cl.[4] ..... A63B 67/04

[52] U.S. Cl. ..... 273/30; 273/395; 135/16

[58] Field of Search ..... 273/30, 395; 135/16, 135/66

[56] References Cited

U.S. PATENT DOCUMENTS

| | | | |
|---|---|---|---|
| 2,066,159 | 12/1936 | Post | 273/30 |
| 2,174,884 | 10/1939 | Kachel | 273/30 |
| 2,781,194 | 2/1957 | Sistrunk | 273/30 |
| 3,059,927 | 10/1962 | Kamp | 273/85 F |
| 3,062,544 | 11/1962 | Viets | 273/30 |
| 3,088,735 | 5/1963 | Clark | 273/30 |
| 3,782,435 | 1/1974 | Sherman | 135/16 |
| 3,968,967 | 7/1976 | Nally | 273/95 A |
| 4,134,585 | 1/1979 | Semon | 273/30 |

*Primary Examiner*—Robert E. Garrett
*Assistant Examiner*—John T. Kwon
*Attorney, Agent, or Firm*—Ridout & Maybee

[57] ABSTRACT

A rebounding ball game comprising a circular planar horizontal court and a deflecting element having a spherical concave rebound surface mounted generally orthogonal to the court, such that a substantial portion of the rebound surface extends above the court and a substantial portion of the court extends forwardly of the rebound surface. Players position themselves on generally opposite sides of the court forwardly of the rebound surface and propel a ball against the rebound surface to deflect onto the court in order to score points. The court may be provided with an aperture defining an out-of-play region, and may be elevated by a tripod or other suitable support. In another embodiment, the deflecting element may be pivoted on a support to be displaced from a position in which it is mounted orthogonal to the court to a position in which it is supported horizontally above the court and shields the court from adverse weather conditions.

17 Claims, 5 Drawing Sheets

FIG 4
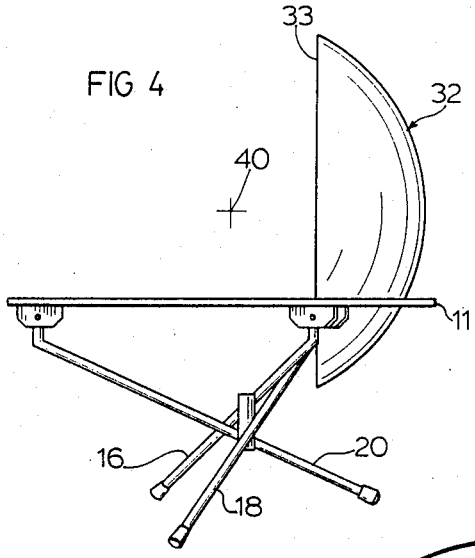
FIG.5.
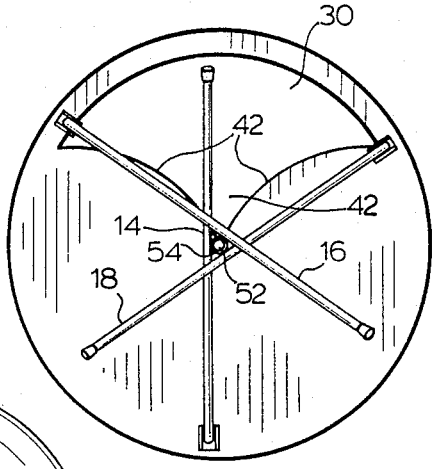
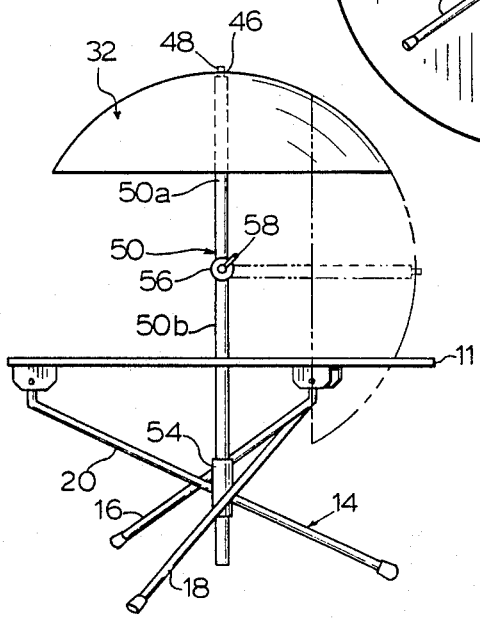
FIG.6.

REBOUNDING BALL GAME

FIELD OF THE INVENTION

The present invention relates to rebounding ball games.

In particular, the present invention relates to an apparatus for a rebounding ball game in which competitors score points by bouncing a ball against a vertical concave spherical deflector such that the ball rebounds into a designated area of an associated planar horizontal court.

BACKGROUND OF THE INVENTION

Rebounding ball games are known in which competing players propel a ball against a rebound surface or backboard, attempting to place the ball strategically within a court or defined area to prevent an opponent from successfully returning the ball and thus score points. Such games as squash and racquetball are played in a full court in which the players position themselves on the court for play.

Tabletop rebounding ball games also exist wherein the court is defined by the upper surface of an elevated sheet of rigid material. As an example, backboards are known for attachment to a rectangular table tennis table, whereby players position themselves at one end of the table and propel a ball against a vertical backboard extending upwardly from the table at the other end. In these games as well players score points by rebounding the ball against the backboard to place it in a strategic position on the court, usually on the players' side of a net extending across the court between the players and the backboard, to prevent its return by the other player.

Players develop skill at such rebounding ball games through practice by learning where the ball will land on the court if propelled with a selected force against the backboard at a selected angle. Where the backboard is planar, as is generally the case, the angle of incidence of the ball relative to a normal to the backboard at the point of contact by the ball equals the angle of deflection relative to such normal. A skilled player may thus accurately place the ball at a selected position on the court by propelling it with appropriate force and at an appropriate angle against the backboard.

The present invention provides a rebounding ball game having a circular court and a spherical vertical rebound surface. The rebound characteristics of the game contemplated by the present invention differ significantly from those utilizing a planar backboard surface, in that, in the apparatus of the present invention, the angle of incidence of the ball will equal the angle of deflection relative to a radius from the notional centre of the spherical rebound surface to the point of contact thereon by the ball. The direction of the reference radius thus varies depending upon the point of contact by the ball with the spherical rebound surface, thereby increasing the difficulty of the game.

A player develops skill in the game contemplated by the apparatus of the present invention by learning the direction of the reference radius, relative to which the angle of incidence of the ball equals the angle of its deflection, at various points on the spherical rebound surface. A skilled player may thus, by propelling the ball with a selected force at a selected position on the spherical rebound surface, anticipate the resulting placement of the ball on the court, and the player may accordingly place the ball strategically on the court to prevent its return by his opponent.

SUMMARY OF THE INVENTION

The present invention provides, in a preferred embodiment, an apparatus for a rebounding ball game comprising a court adapted for a generally horizontal orientation, and a deflecting element having a forward spherical concave rebound surface and a peripheral edge, adapted to be mounted generally vertically relative to the court such that at least a substantial portion of the court extends forwardly of the deflecting element and at least a substantial portion of the deflecting element extends upwardly from the court with the peripheral edge generally orthogonal thereto.

In another embodiment, the present invention provides, in combination, a table having a generally planar elevated court and a deflecting element having a forward spherical concave rebound surface and a peripheral edge, the deflecting element being adapted to be mounted such that the peripheral edge is generally vertical with at least a substantial portion of the court extending forwardly of the rebound surface and at least a substantial portion of the rebound surface extending upwardly from the court.

In still another embodiment, the present invention provides an apparatus for a rebounding ball game, comprising a table having legs and a generally planar court adapted for horizontal mounting thereon, and a deflecting element having a forward spherical concave rebound surface and a peripheral edge and means for removably securing a support, whereby the deflecting element can be displaced between a position wherein at least a substantial portion of the rebound surface extends upwardly from the court, a substantial portion of the court extends forwardly of the rebound surface and the peripheral edge is generally orthogonal to the court, and a position wherein the deflecting element rests on the support above the table with the peripheral edge generally horizontal to shield the court from adverse weather conditions.

BRIEF DESCRIPTION OF THE DRAWINGS

In drawings which illustrate, by way of example only, preferred embodiments of the invention.

FIG. 4 is a side elevation of the apparatus of FIG. 1;

FIG. 5 is a bottom plan view of the apparatus of FIG. 1 without the deflecting element;

FIG. 6 is a side elevation of another embodiment of the apparatus of the present invention showing a vertical orientation of the deflecting element in phantom lines;

DETAILED DESCRIPTION OF THE INVENTION

Figure 1:
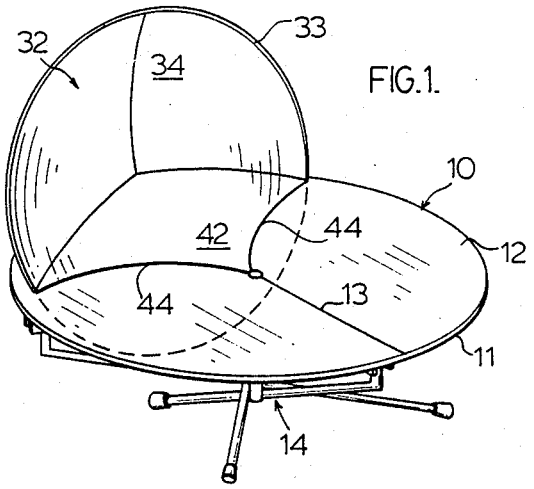
FIG. 1 is a perspective view of the apparatus of one embodiment of the present invention.

In a preferred embodiment of the invention, there is provided a table 10 having a generally planar horizontal court 12 supported by a tripod 14.

The court 12 is preferably the upper surface of a horizontal sheet 11 of rigid material, such as wood or plastic, with suitable reinforcement to prevent sagging. The horizontal sheet 11 is preferably an integral sheet, however it may be composed of any number of integrated pieces such that such pieces when assembled provide an integral surface for the court 12.

The court 12 may be supported by any suitable structure, such as a pedestal, or by legs. Preferably support for the court 12 comprises a tripod 14 having legs 16, 18, 20 attached to the underside of the sheet 11 at points about the periphery thereof, each point being approximately equidistant from the other two for maximum support. The legs 16, 18, 20 are directed inwardly and connected at a common junction 22, each leg extending therebeyond to contact the ground or floor. Levellers may be included to ensure that the court 12 is properly level. Moreover, legs 16, 18, 20 may be composed of telescoping sections to adjust the height of the court 12.

Preferably each leg is attached to the underside of the sheet 11, as aforesaid, by means of a pin 26 removably received through opposed holes in a bracket 28 and complimentary holes through the upper end of the leg. Thus, the legs 16, 18, 20 can be detached from sheet 11 simply by removal of the pins 26.

Cut out of the court 12 adjacent to an edge thereof is a crescent-shaped aperture 30 having a lip 31. A deflecting element 32 having a concave spherical rebound surface 34 is mounted in the aperture 30 such that its peripheral edge 33 is approximately orthogonal to the court 12. The aperture 30 is wide enough to permit the deflecting element 32 to be removably mounted therein with sufficient stability to retain the deflecting element 32 in the desired vertical orientation, preferably such that approximately one quarter of the spherical rebound surface 34 depends below the level of the court 12.

The deflecting element 32 is preferably composed of three equal sections of a rigid material such as wood or plastic which lock together tongue-in-groove or by means of tracks or clips or other known means which permit easy disassembly for transporting. The spherical rebound surface 34 of the deflecting element 32 consists of a portion of a sphere as described in greater detail below.

In use the apparatus is assembled as described above. Depending upon the rules agreed to between competing players, the players position themselves generally on opposite sides of the centre line 13 on the court 12 forwardly of the rebound surface 34 of the deflecting element 32. A resilient ball can rebound in any permitted combination against the court 12 and the rebound surface 34, although it is intended that the ball be propelled by the players toward the rebound surface 34 to rebound therefrom onto the court 12. The ball may be propelled by the players by hand or by racquets utilized in known rebounding ball games or any equivalent thereof.

Utilizing the notional centre 40 of the spherical rebound surface 34, as illustrated in FIG. 4, a player may anticipate the angle of rebound of the ball striking the spherical rebound surface 34 by conceptualizing a radius from the notional centre 40 to the point of contact of the ball on the rebound surface 34. The angle of incidence of the ball relative to this imaginary radius will equal the angle of deflection of the ball relative thereto. A player may thus predict the direction that the ball will rebound off of the rebound surface 34 for placement at a strategic location on the court 12.

As indicated above, in practice, the game contemplated by the subject invention is played differently from rebounding ball games played against a planar vertical backboard. In the latter case, in order to place the ball selectively further across the court, i.e. away from the player, the player can propel the ball to strike the backboard with the same force at correspondingly greater distances from himself. In the game of the present invention, in order to place the ball at selectively further points across the court 12 the player can propel the ball to strike points on the spherical rebound surface 34 correspondingly closer to the player.

The same principle applies to depth placement, in that in games involving a planar backboard, the depth of the placement of the ball on the court increases as the ball strikes selectively higher positions on the planar backboard with the same force. In the apparatus of the present invention in order to place the ball deeper on the court 12, i.e. further from the deflecting element, the player can propel the ball toward a correspondingly lower portion of the spherical rebound surface 34. Again the principle that angle of incidence equals angle of deflection applies, as described above.

Virtually the entire game is played against the upper half of the spherical rebound surface 34. This portion of the spherical rebound surface 34 rebounds the ball downwardly toward the court 12. Thus, propelled toward an appropriate location in the upper half of the rebound surface 34 the ball will land within the court regardless of the force of the rebound. Propelling the ball against the lower half of the spherical rebound surface 34 will cause the ball to rebound upwardly and, depending upon the force of the rebound, past the edge of the court 12.

The court 12 preferably has cut out adjacent to the crescent-shaped aperture 30 an extension thereof defined by two arcuate edges 44 having a lip 31 and approximating the curvature of the spherical rebound surface 34 and extending between the centre line 13 of the court 12 and the tips of the crescent shaped aperture 30. This provides an aperture 42 in the court 12 which can serve the purposes of both defining an out-of-play region of the court, if the ball drops through the aperture 42, and providing a means for enabling the ball to be directed upwardly through to the spherical rebound surface 34 from beneath the level of the court 12 in order to keep the ball in play. The aperture 42 may be smaller or omitted entirely to render the game easier to play.

In another preferred embodiment, illustrated in FIG. 6, a hole 46 is presented through approximately the centre of the deflecting element 32 for receiving a pin 48 at the end of a post 50. The post 50 may be positioned through a hole 52 through the approximate centre of the court 12 and an annular ring or sleeve 54 forming the junction 22 of the legs 16, 18, and 20 of the tripod 14. The post 50 thus rests on the ground or floor and can support the deflecting element in a horizontal position to act as an umbrella protecting the court 12 from adverse weather conditions such as sunlight and precipitation. A plug (not shown) may be used to conceal the hole 46 when the game is in play.

The post 50 is preferably composed of two sections, 50*a* and 50*b*, joined by a releasable hinge 56. A lever 58 which locks or releases the hinge 56 permits the deflecting element 32 to be raised to a selected orientation between the vertical and the horizontal.

Figure 14:
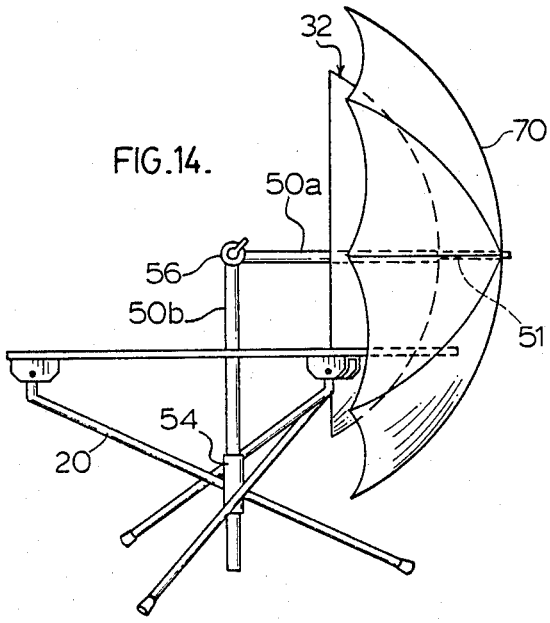
FIG. 14 is a side elevation of still another embodiment of the present invention.

In another embodiment, the post 50 may also be provided with an umbrella structure 70 spaced from the deflecting element 32, as illustrated in FIG. 14. In this embodiment the deflecting element 32 has a hole 46 large enough to accept a constricted extension 51 of the post 50, with the pin 48 projecting therefrom which may be capped to secure the umbrella 70. This enables the deflecting element 32 to pivot downwardly directly into the aperture 30, while the umbrella 70 is sufficiently spaced from the deflecting element 32 that when pivoted downwardly it clears the margin of the court, and can act as a backdrop to capture balls propelled past the deflecting element 32. The post 50 in this embodiment is not removed from the court 12 when the game is in play. When the post 50 is upright the deflecting element 32 is substantially concealed by the umbrella 70.

Figure 8:
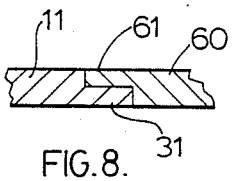
FIG. 8 is a partial cross-section of the apparatus of FIG. 7.
Figure 9:
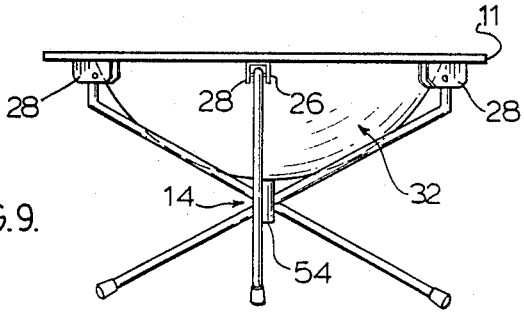
FIG. 9 is a front elevation of still another embodiment of the present invention.

In still a further embodiment the apparatus of the present invention may be used as an outdoor or indoor table. In this embodiment the deflecting element 32 can be stored underneath the sheet 11, nested on the legs 16, 18 and 20 of the tripod 14, as illustrated in FIG. 9, by detaching the sheet 11 from the tripod 14, and reattaching same after positioning the deflectment element 32. An insert 60, preferably composed of the same material having the same thickness as the sheet 11 and congruent with the shape of the apertures 30, 42 can be placed into the apertures 30, 42 to provide a uniform tabletop surface. The insert 60 has a lip 61 complimentary to the lip 31 of the aperture, as illustrated in FIG. 8, to retain the insert 60 in the aperture. The apparatus may then easily be converted back to the rebounding ball game embodiment for play when desired by removal of the insert 60 and mounting of the deflecting element 32.

The apparatus of the present invention may be constructed to any size suitable for the players. Preferably in the tabletop version the court 12 is circular and approximately five feet in diameter. Preferably also the horizontal sheet 11 is round, to conform with the court 12. Because of the manner in which the ball rebounds off of the spherical rebound surface 34 it has been determined that the most preferable shape for the court 12 is a circle, and for easiest movement by the players around the court 12, the horizontal sheet 11 should similarly be circular and no larger than the court.

Figure 10:
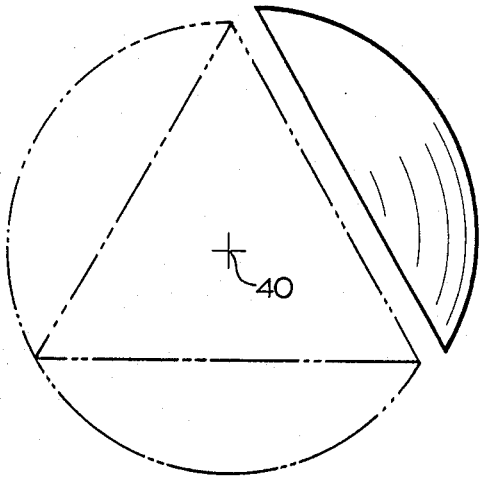
FIG. 10 is a representational plan view illustrating the preferred spherical sector for the spherical rebound surface.
Figure 11:
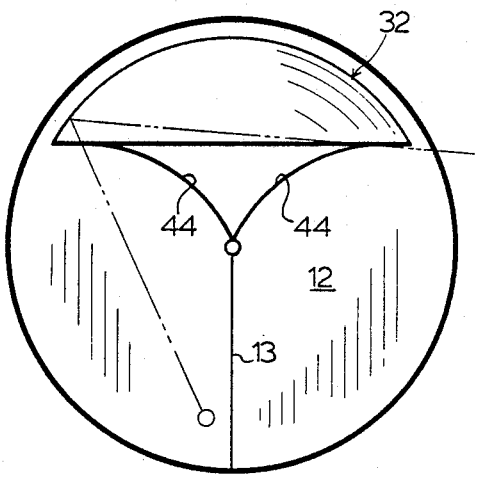
FIG. 11 is a top plan view of the apparatus of FIG. 1 illustrating the path of a ball rebounding off of a spherical rebound surface of a configuration as illustrated in FIG. 10.
Figure 12:
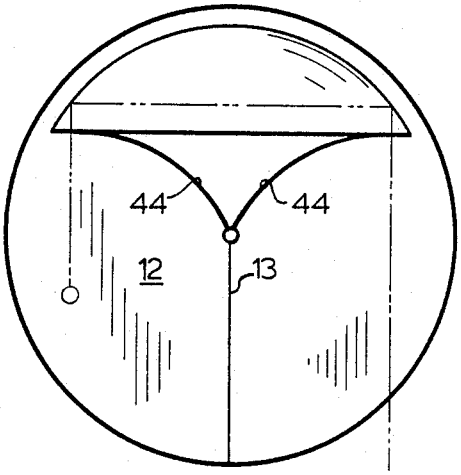
FIG. 12 is a top plan view of the apparatus of FIG. 1 illustrating another path of a ball rebounding off of a spherical rebound surface of a configuration as illustrated in FIG. 10.

For a court of this size the spherical rebound surface 34 is preferably approximately four feet in diameter at the peripheral edge 33, and represents the cap of a spherical sector of a sphere approximately 4.7 feet in diameter obtained when the plane of the spherical sector intersects one side of an equilateral triangle intersecting the great circle of the sphere, at right angles to the triangle, as illustrated in FIG. 10. With a rebound surface 34 of this configuration, a ball propelled from the side of the court barely glancing one side of the peripheral edge 33 of the deflecting element 32 and rebounding off of the other side of the spherical rebound surface 34 at the peripheral edge 33 will not deflect past the centre line 13, as illustrated in FIG. 11. Furthermore, as illustrated in FIG. 12, multiple rebounds are possible from a single shot.

Figure 2:
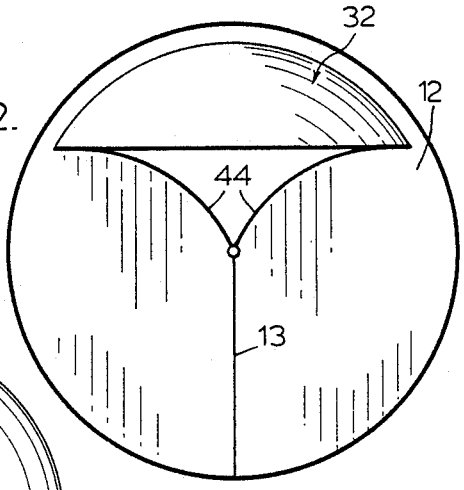
FIG. 2 is a top plan view of the apparatus of FIG. 1.
Figure 3:
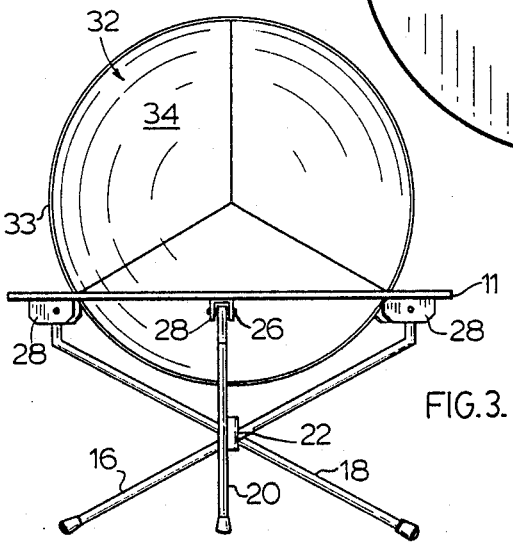
FIG. 3 is a front elevation of the apparatus of FIG. 1.
Figure 7:
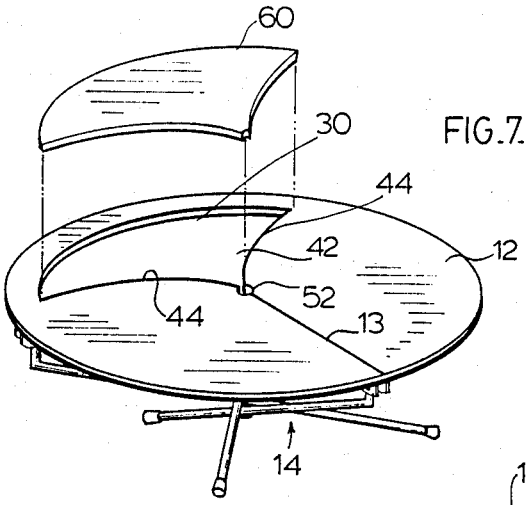
FIG. 7 is a partly exploded perspective view of still another embodiment of the present invention.

Preferably also the centre 40 of the spherical rebound surface 34 is in vertical alignment with the centre of the court 12, resulting in a margin of approximately 0.3 feet around the deflecting element 32, as illustrated in FIG. 2. This enables a player to propel the ball toward the rebound surface 34 so that it rolls along the rebound surface 34 and, once past the peripheral edge 33, can still land on the court 12 at the margin thereof.

Figure 13:
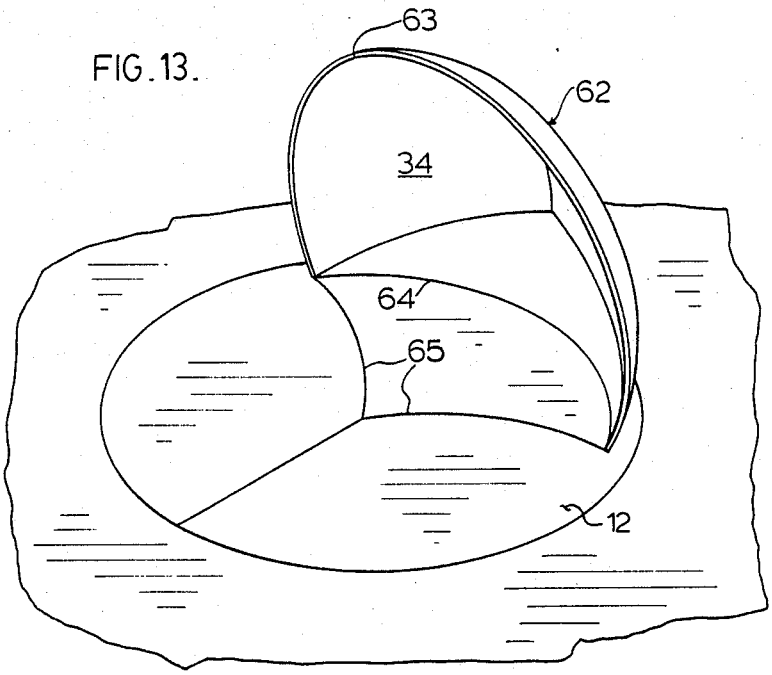
FIG. 13 is a perspective view of still another embodiment of the present invention.

The game to which the apparatus of the present invention is directed may be played as well on a full-court. A deflecting element 62 having a rebound surface 34 with the same configuration described above but suitably larger may be mounted on the floor or ground. The court 12 may be delineated on the floor or ground forward of the spherical rebound surface 34, preferably proportionally having the same relative dimensions as those described above in connection with the tabletop version of the apparatus. The apertures 30, 42 may be cut out of the floor or dug out of the ground to provide a mount for the deflecting element 62 and an out-of-play zone as aforesaid. Alternatively, the deflecting element 62 may be severed along its peripheral edge 63 to form a bottom edge 64 upon which the deflecting element 62 rests, and lines 65 may be drawn to delineate an out-of-play area of the court 12, as illustrated in FIG. 13. The type of ball and, if desired, racquet used would be those more appropriate to a full-court sport such as racquetball or squash, or modifications thereof.

Having thus described the present invention, it will be obvious to those skilled in the art that various modifications and adaptations may be made without departing from the scope of the invention so described. The foregoing description is by way of nonlimiting example only, and the invention includes all such modifications and adaptations as may be within the scope of the claims which follow.

We claim:

1. Apparatus for a rebounding ball game comprising a generally circular court adapted for a generally horizontal orientation, and a deflecting element having a forward spherical concave rebound surface and a peripheral edge, adapted to be mounted generally vertically relative to the court such that at least a substantial portion of the court extends forwardly of the deflecting element and at least a substantial portion of the deflecting element extends upwardly from the court with the peripheral edge generally orthogonal thereto.

2. Apparatus as defined in claim 1 wherein the court is adapted to be raised from the floor or ground.

3. Apparatus as defined in claim 2 wherein the court is adapted to be supported by a detachable tripod.

4. Apparatus as defined in claim 3 wherein the tripod is adapted to receive the deflecting element in nested relation.

5. Apparatus as defined in claim 1 wherein the deflecting element is adapted to be mounted such that approximately one-quarter of the rebound surface depends downwardly from the court.

6. Apparatus as defined in claim 5 wherein the court is provided with an aperture adapted to receive the deflecting element.

7. Apparatus as defined in claim 1 wherein the court is provided with an aperture defining an out-of-play region.

8. Apparatus as defined in claim 1 wherein the rebound surface approximates the cap of a spherical sector obtained when the plane of the spherical sector intersects one side of an equilateral triangle intersecting the great circle of a sphere.

9. In combination, a table having a generally planar elevated generally circular court and a deflecting element having a forward spherical concave rebound surface and a peripheral edge, the deflecting element being adapted to be mounted such that the peripheral edge is generally vertical, at least a substantial portion of the court extends forwardly of the rebound surface and at least a substantial portion of the rebound surface extends upwardly from the court.

10. The combination as defined in claim 9 wherein the court is adapted to be supported by a detachable tripod.

11. The combination as defined in claim 10 wherein the tripod is adapted to receive the deflecting element in nested relation and including an insert adapted to be removably received in an aperture in the court.

12. Apparatus for a rebounding ball game comprising a table having legs and a generally planar court adapted for horizontal mounting thereon, and a deflecting element having a forward spherical concave rebound surface and a peripheral edge and means for removably securing a support, whereby the deflecting element can be displaced between a position wherein at least a substantial portion of the rebound surface extends upwardly from the court, a substantial portion of the court extends forwardly of the rebound surface and the peripheral edge is generally orthogonal to the court, and a position wherein the deflecting element rests on the support above the table with the peripheral edge generally horizontal to shield the court from adverse weather conditions.

13. Apparatus as defined in claim 12 wherein the support comprises a post having an upper portion and a lower portion connected by a hinge.

14. Apparatus as defined in claim 13 wherein the hinge includes a locking mechanism for maintaining the upper portion of the post in a selected orientation relative to the lower portion of the post.

15. Apparatus as defined in claim 13 including an umbrella structure adapted to be supported by the post in spaced relation from the deflecting element such that when the peripheral edge is generally orthogonal to the court the umbrella structure creates a backdrop to capture stray shots and when the peripheral edge is generally horizontal the umbrella structure shields the deflecting element and the court from adverse weather conditions.

16. Apparatus for a rebounding ball game comprising a court adapted for a generally horizontal orientation, and a deflecting element having a forward spherical concave rebound surface and a peripheral edge, adapted to be mounted generally vertically relative to the court such that at least a substantial portion of the court extends forwardly of the deflecting element and at least a substantial portion of the deflecting element extends upwardly from the court with the peripheral edge generally orthogonal thereto, wherein the court is provided with an aperture defining an out-of-play region.

17. An apparatus as defined in claims 1, 9 or 16 further comprising a post adapted to be positioned generally vertically through an approximate centre of the court.

* * * * *